US012529274B2

(12) United States Patent
Schultz et al.

(10) Patent No.: US 12,529,274 B2
(45) Date of Patent: Jan. 20, 2026

(54) DOWNHOLE PLUG DEPLOYMENT

(71) Applicant: THRU TUBING SOLUTIONS, INC., Newcastle, OK (US)

(72) Inventors: Roger L. Schultz, Ninnekah, OK (US); Timothy Manke, Oklahoma City, OK (US); Andrew M. Ferguson, Moore, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/300,749

(22) Filed: Apr. 14, 2023

(65) Prior Publication Data

US 2023/0258047 A1 Aug. 17, 2023

Related U.S. Application Data

(62) Division of application No. 17/566,264, filed on Dec. 30, 2021, now Pat. No. 11,834,919.

(60) Provisional application No. 63/137,545, filed on Jan. 14, 2021.

(51) Int. Cl.
*E21B 23/04* (2006.01)
*E21B 34/14* (2006.01)

(52) U.S. Cl.
CPC ..... *E21B 23/0413* (2020.05); *E21B 34/142* (2020.05); *E21B 2200/08* (2020.05)

(58) Field of Classification Search
CPC ..... E21B 23/0413; E21B 2200/08
See application file for complete search history.

(56) References Cited

U.S. PATENT DOCUMENTS 4,058,163 A * 11/1977 Yandell ..... E21B 43/003 175/231
4,187,909 A * 2/1980 Erbstoesser ..... E21B 43/261 166/292
5,404,945 A * 4/1995 Head ..... E21B 21/10 138/42
5,494,107 A * 2/1996 Bode ..... E21B 33/14 166/323
6,155,350 A * 12/2000 Melenyzer ..... E21B 34/14 166/317
7,530,400 B2 * 5/2009 Telfer ..... E21B 23/00 166/243

(Continued)

FOREIGN PATENT DOCUMENTS

WO 2012067786 A2 5/2012
WO 2019116042 A1 6/2019

OTHER PUBLICATIONS

Office Action issued May 10, 2023 for U.S. Appl. No. 17/566,264, 18 pages.

(Continued)

*Primary Examiner* — Neel Girish Patel
(74) *Attorney, Agent, or Firm* — Smith IP Services, P.C.

(57) ABSTRACT

A method of deploying a plug in a subterranean well can include positioning a tool string in the well, the tool string including a plug release tool and a well tool, then releasing the plug from the plug release tool, and then operating the well tool in response to the releasing the plug. A plug release tool for use in a subterranean well can include an outer housing, and an insert secured in the outer housing, the insert including multiple longitudinally extending flow passages formed through the insert.

10 Claims, 14 Drawing Sheets

(56) References Cited

U.S. PATENT DOCUMENTS 7,866,397 B2 * 1/2011 Lee ..... E21B 34/14 166/318
9,316,089 B2 * 4/2016 Kellner ..... E21B 34/06
9,366,095 B2 * 6/2016 Stephenson ..... E21B 34/14
9,404,330 B2 * 8/2016 Speer ..... E21B 34/142
9,970,264 B2 * 5/2018 Tulloch ..... E21B 10/00
10,280,706 B1 * 5/2019 Sharp, III ..... E21B 33/134
10,781,654 B1 * 9/2020 Schultz ..... E21B 37/10
2007/0062706 A1 * 3/2007 Leising ..... E21B 34/142 166/70
2007/0272412 A1 * 11/2007 Telfer ..... E21B 34/14 166/318
2008/0066924 A1 * 3/2008 Xu ..... E21B 34/14 166/376
2009/0159297 A1 * 6/2009 Fould ..... E21B 23/04 166/387
2009/0308588 A1 * 12/2009 Howell ..... E21B 23/006 166/66.4
2012/0043093 A1 * 2/2012 Cravatte ..... E21B 34/142 166/376
2012/0061103 A1 * 3/2012 Hurtado ..... E21B 34/00 166/318
2013/0240200 A1 * 9/2013 Frazier ..... E21B 33/129 166/135
2014/0102709 A1 * 4/2014 Arabskyy ..... E21B 43/14 166/308.1
2015/0068727 A1 * 3/2015 Hern ..... E21B 23/08 166/114
2015/0068771 A1 * 3/2015 Richards ..... E21B 23/0413 166/386
2015/0144342 A1 * 5/2015 Schultz ..... E21B 21/103 166/298
2015/0239795 A1 * 8/2015 Doud ..... C06B 45/32 149/7
2015/0345256 A1 * 12/2015 Tulloch ..... E21B 33/12 175/263
2016/0024885 A1 * 1/2016 Schultz ..... E21B 43/114 166/298
2016/0186511 A1 * 6/2016 Coronado ..... E21B 43/26 166/381
2016/0230487 A1 * 8/2016 Schultz ..... E21B 31/005
2016/0312581 A1 * 10/2016 Nordheimer ..... E21B 34/063
2017/0089175 A1 * 3/2017 Doane ..... E21B 23/006
2017/0107419 A1 * 4/2017 Roy ..... B22F 1/12
2017/0362913 A1 * 12/2017 Randle ..... E21B 33/1208
2018/0187516 A1 * 7/2018 Schultz ..... E21B 21/103
2018/0283123 A1 * 10/2018 Baudoin ..... E21B 31/1135
2019/0264538 A1 * 8/2019 Bowersock ..... E21B 34/103
2019/0314559 A1 * 10/2019 Baker ..... A61L 31/148
2020/0109608 A1 * 4/2020 Elfar ..... E21B 34/142
2021/0087888 A1 * 3/2021 Macfarlane ..... E21B 10/62
2021/0230972 A1 * 7/2021 Macek ..... E21B 43/08
2021/0396088 A1 * 12/2021 Schultz ..... E21B 31/113
2022/0220819 A1 7/2022 Schultz et al.

OTHER PUBLICATIONS

International Search Report with Written Opinion issued Apr. 28, 2022 for PCT Patent Application No. PCT/US2021/065718, 12 pages.
Canadian Examination Report issued Sep. 23, 2024 for CA Patent Application No. 3,199,582, 4 pages.

* cited by examiner

DOWNHOLE PLUG DEPLOYMENT

CROSS-REFERENCE TO RELATED APPLICATIONS

This application is a division of U.S. application Ser. No. 17/566,264 filed on 30 Dec. 2021, which claims the benefit of the filing date of U.S. provisional application No. 63/137,545 filed on 14 Jan. 2021. The entire disclosures of these prior applications are incorporated herein by this reference.

BACKGROUND

This disclosure relates generally to equipment utilized and operations performed in conjunction with a subterranean well and, in one example described below, more particularly provides for plug deployment downhole.

It can be advantageous to be able to control fluid flow in a well. For example, well tools can be activated or deactivated by deploying a plug into a tubular string from the surface. Plugs can be used to operate valves or prevent flow through flow passages when desired.

Therefore, it will be appreciated that improvements are continually needed in the art of controlling fluid flow in a well. The present disclosure provides such improvements, which may be utilized in a wide variety of different well operations and with a wide variety of different well systems.

DETAILED DESCRIPTION

Figure 1:
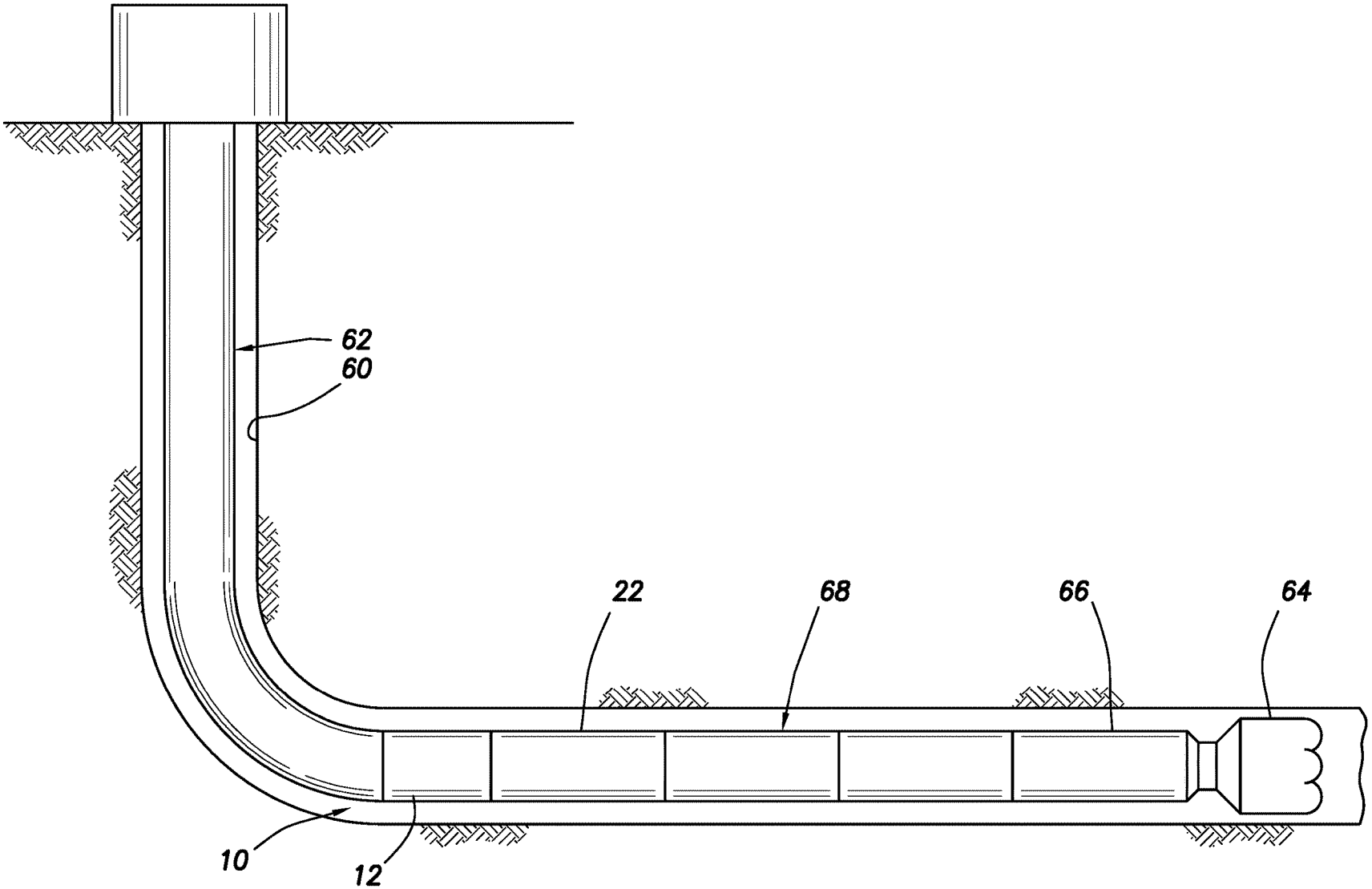
FIG. 1 is a representative partially cross-sectional view of an example of a well system and associated method which can embody principles of this disclosure.

Representatively illustrated in FIG. 1 is a system 10 for use with a subterranean well and an associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a drill string 62 has been deployed into a wellbore 60, in order to drill the wellbore further into the earth. For this purpose, the drill string 62 includes a drill bit 64 connected at its distal end. The drill bit 64 is part of a tool string 68 or bottom hole assembly (BHA). Note that it is not necessary in keeping with the principles of this disclosure for a BHA to be positioned at a bottom of a hole, wellbore or any other specific position in a well.

In addition, it is not necessary for a drilling operation to be performed. The drill string 62 could be another type of tubular string, such as a completion string, a workover string, etc. The scope of this disclosure is not limited to any particular well operation or function performed with a tubular string in a well.

As depicted in FIG. 1, a vibratory tool 22 is connected in the drill string 62 as part of the BHA 68. The vibratory tool 22 is used in this example to assist in deploying the drill string 62 into a generally horizontal section of the wellbore 60. When operational, the vibratory tool 22 produces vibrations, for example, due to pressure fluctuations, accelerations of mass, impacts, or other stimulus caused by the vibratory tool. The vibrations produced by the vibratory tool 22 reduce friction between the drill string 62 and the wellbore 60, thereby enabling the drill string to displace more readily along the wellbore.

A downhole plug release tool 12 is also connected in the drill string 62 as part of the BHA 68. The plug release tool 12 is used to release a plug (such as, a ball, a dart, etc.) downhole, so that the plug can engage the vibratory tool 22 to thereby operate the vibratory tool. In this example, the engagement of the plug with the vibratory tool 22 may be used to activate or deactivate the vibratory tool, that is, to cause the vibrations to be produced by the vibratory tool, or to cause the vibrations to cease.

In other examples, the vibratory tool 22 may not be used. For example, the release of the plug 14 could instead be used to operate a drill motor 66, a stabilizer, a reamer, or another type of well tool. The scope of this disclosure is not limited to use of the plug release tool 12 to operate any particular type of well tool, or to cause any particular function to be performed in the well. The plug release tool 12 may be used to activate or deactivate any type of well tool.

As depicted in FIG. 1, the vibratory tool 22 is positioned in a generally horizontal section of the wellbore 60. It is desired in this example for the vibratory tool 22 to produce vibrations when the BHA 68 is in the generally horizontal section of the wellbore 60, since this is when the friction between the drill string 62 and the wellbore is greatest, and vibrations may be undesirable when the BHA 68 is in a generally vertical section of the wellbore.

Note that it is not necessary for the BHA 68 or any other portion of a tubular string to be positioned in a generally horizontal or otherwise inclined section of a wellbore, or for the wellbore to even include a generally horizontal section, when a well tool is operated using the plug release tool 12. The plug release tool 12 could be used to operate a well tool in a vertical section of a wellbore in keeping with the scope of this disclosure.

In some examples it may be desired to cease operation of the vibratory tool 22 when the drill motor 66 and drill bit 64 are being used to drill into the earth. For example, the vibrations produced by the vibratory tool 22 might otherwise be too energetic when sufficient fluid is flowed through the drill string 62 to operate the drill motor 66. In such examples, it may be desired to cease production of the vibrations after the BHA 68 is positioned in the generally horizontal section of the wellbore 60 but before commencing drilling.

Figure 2A:
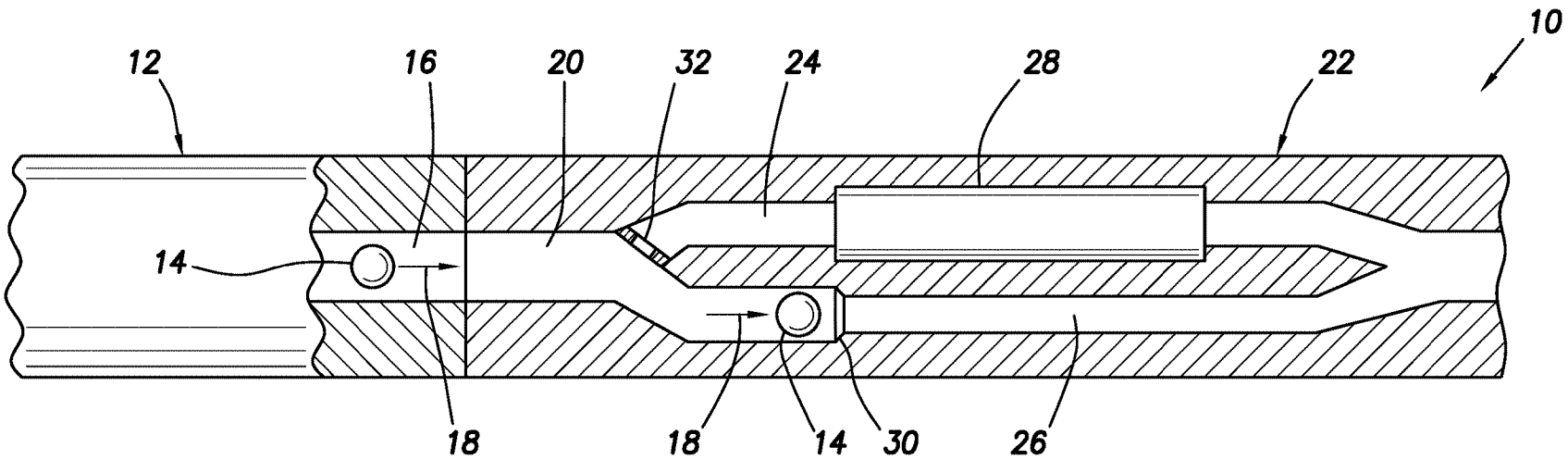
FIGS. 2A & B are representative partially cross-sectional views of examples of vibratory tools that may be used with the FIG. 1 system and method.

Referring now to FIGS. 2A & B, two examples of how the plug release tool 12 may be used to operate the vibratory tool 22 are representatively illustrated. However, as mentioned above, it should be clearly understood that the scope of this disclosure is not limited to operating a vibratory tool using the plug release tool 12, or to operating the vibratory tool 22 in any particular manner.

In the FIG. 2A example, the plug release tool 12 is used to release a plug 14 into a fluid passage 16 of the plug release tool. Fluid flow 18 through the passage 16 conveys the plug 14 into a fluid passage 20 of the vibratory tool 22. The plug 14 may be released in the plug release tool 12 in response to any type of stimulus including, for example, passage of a predetermined time period, exposure to well fluid, degrading (e.g., dissolution, corrosion, melting, oxidation, hydration, etc.) of a layer of the plug, a change in orientation of the plug release tool, and/or a variation in the fluid flow 18 through the plug release tool, or a combination of any of these. The scope of this disclosure is not limited to any particular stimulus or cause for release of the plug 14.

The fluid passage 20 splits in the vibratory tool 22 into an operational flow passage 24 and a bypass flow passage 26. Sufficient fluid flow through the operational flow passage 24 will cause a predetermined pressure differential across a vibratory device 28 and thereby cause the vibratory device to produce vibrations.

The vibratory tool 22 and vibratory device 28 in the FIG. 2A example may be similar to those described in U.S. Pat. No. 9,957,765, which is incorporated herein by this reference in its entirety for all purposes. Other types of vibratory tools and vibratory devices may be used in keeping with the scope of this disclosure.

When the bypass flow passage 26 is open, the predetermined pressure differential is not produced across the vibratory device 28, because the fluid flow 18 is permitted to pass through the bypass flow passage instead of, or in addition to, the operational flow passage 24. However, when the plug 14 sealingly engages a seat 30 in the bypass flow passage 26 (a screen, filter or other exclusion device 32 prevents the plug from being conveyed into the operational flow passage 24), the bypass flow passage is closed and the fluid flow 18 through the bypass flow passage is prevented.

The predetermined pressure differential across the vibratory device 28 is, thus, achieved and the vibrations are produced. In this manner, the vibratory tool 22 can be operated to begin producing the vibrations downhole when desired (such as, when the BHA 68 is in the generally horizontal section of the wellbore 60 in the FIG. 1 system 10).

Figure 2B:
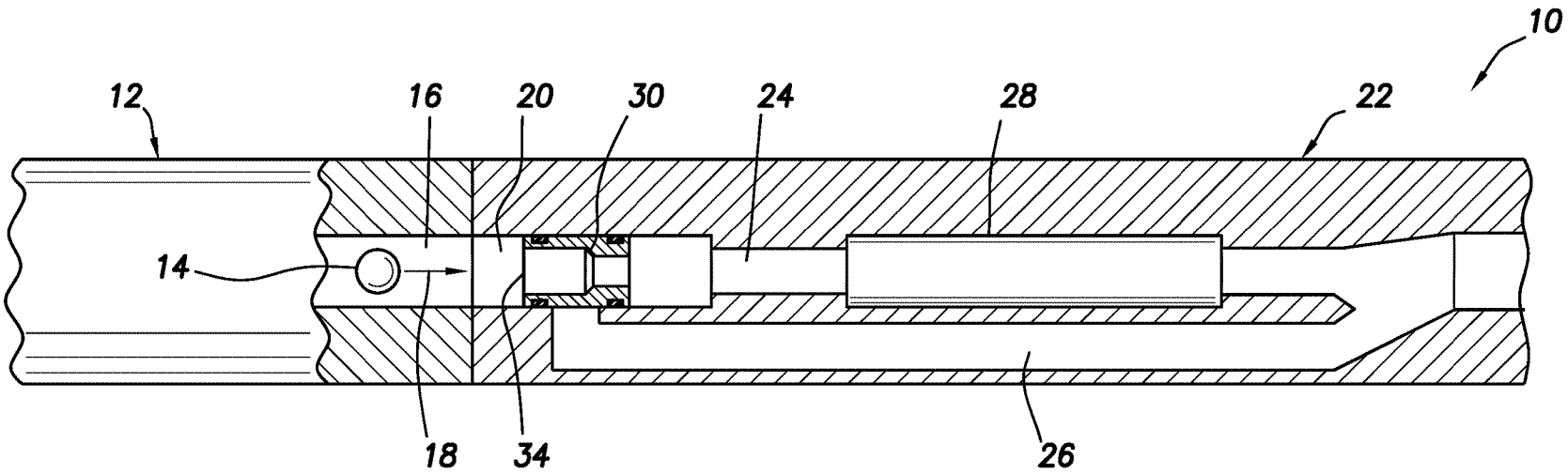

In the FIG. 2B example, the vibratory device 28 is initially able to produce vibrations downhole in response to the fluid flow 18. The bypass flow passage 26 is closed and the predetermined pressure differential can be produced across the vibratory device 28. The vibratory tool 22 can be operated to cease production of the vibrations when desired.

The fluid flow 18 through the bypass flow passage 26 is initially prevented by a sliding sleeve 34. The sliding sleeve 34 may be retained in this initial position by releasable means, such as, a shear pin, snap ring, collets, etc. (not shown).

When the plug 14 is released by the plug release tool 12, the plug can be conveyed by the fluid flow 18 into sealing engagement with the seat 30, which is formed in the sliding sleeve 34 in this example. This sealing engagement prevents the fluid flow 18 from passing through the operational flow passage 24 and, thus, causes the vibrations to cease being produced by the vibratory device 28. In addition, the sleeve 34 will displace to a position in which the fluid flow 18 is permitted to pass through the bypass flow passage 26.

The vibratory tool 22 and vibratory device 28 in the FIG. 2B example may be similar to those described in U.S. Pat. No. 9,181,767, which is incorporated herein by this reference in its entirety for all purposes. Other types of vibratory tools and vibratory devices may be used in keeping with the scope of this disclosure.

Figure 3:
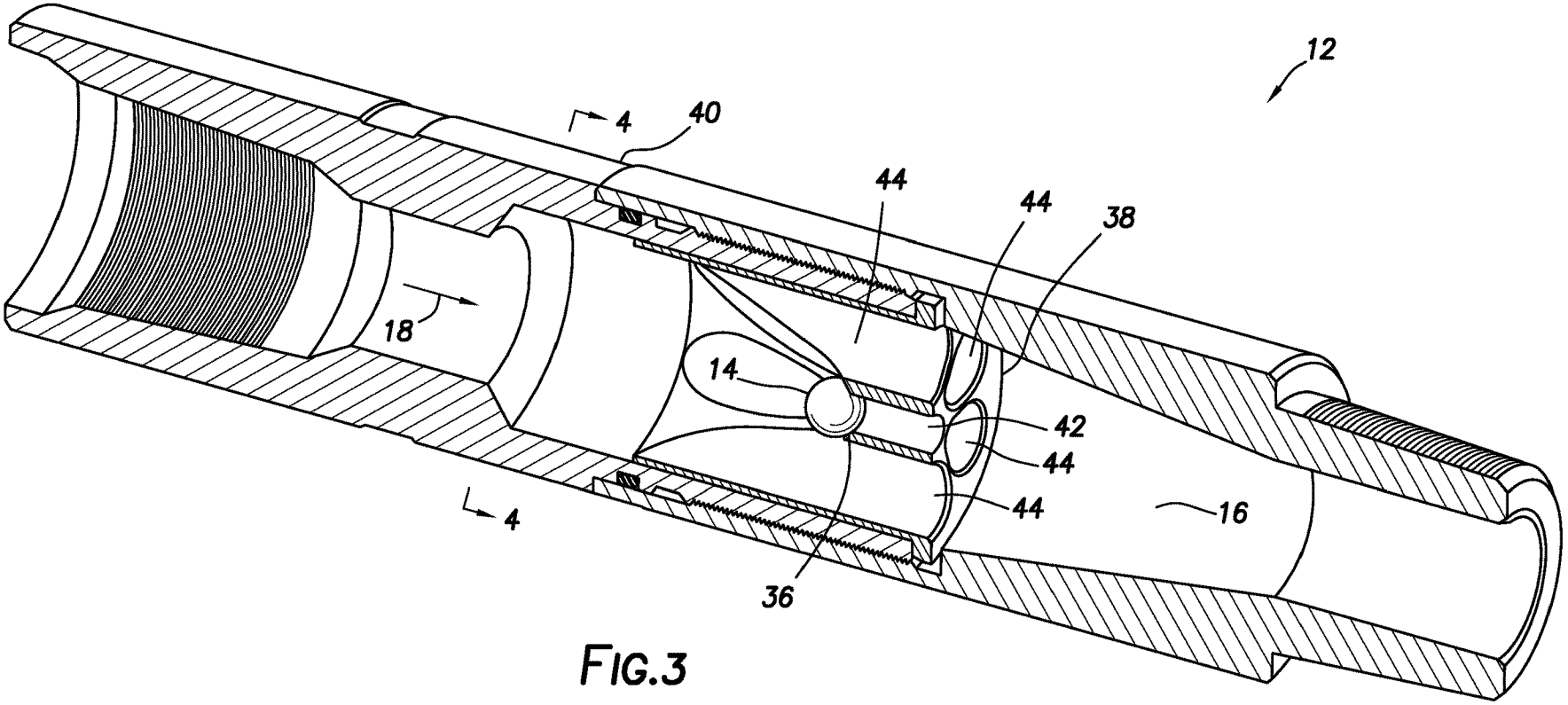
FIG. 3 is a representative cross-sectional and perspective view of an example of a plug release tool that can embody the principles of this disclosure.
Figure 4:
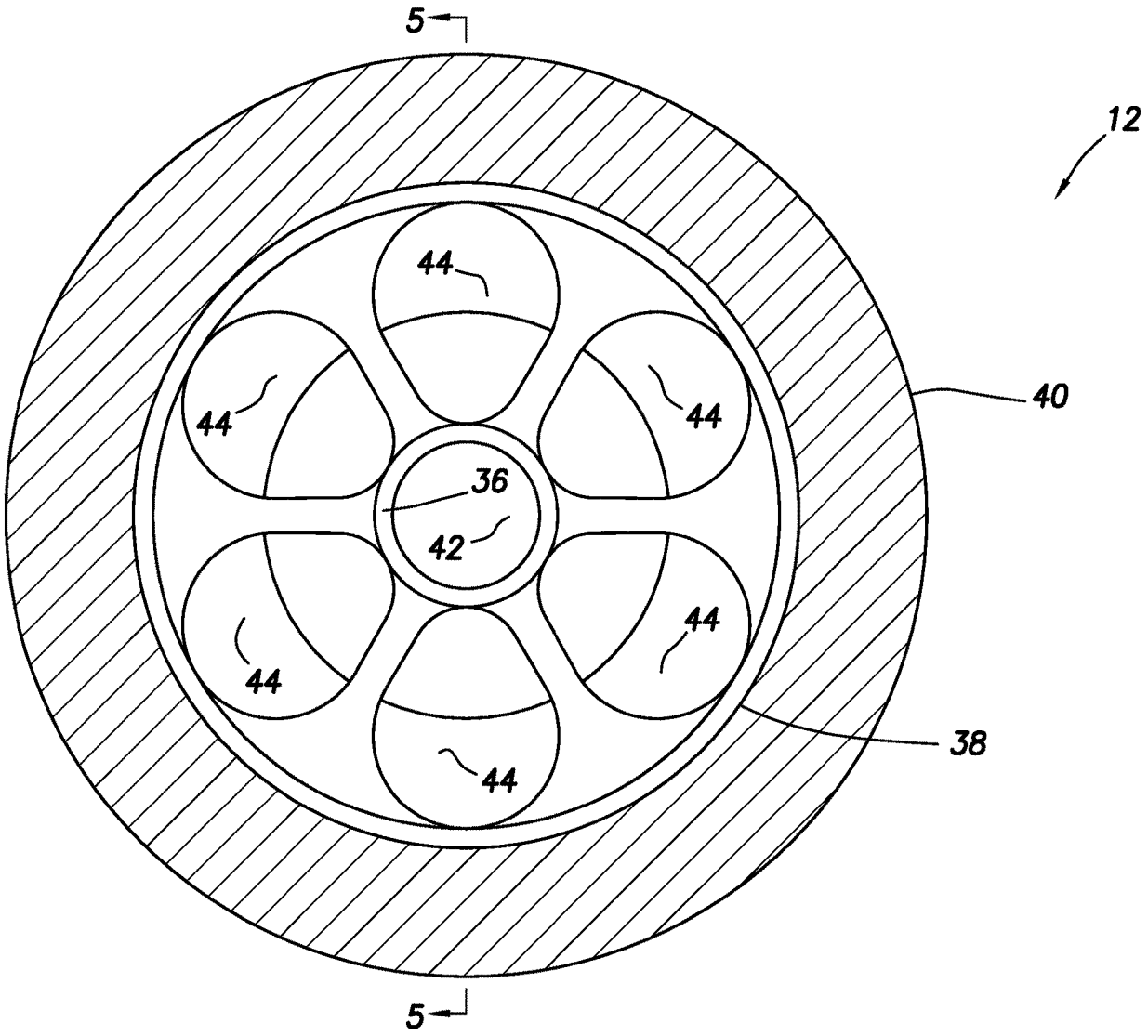
FIG. 4 is a representative cross-sectional view of the plug release tool, taken along line 4-4 of FIG. 3.
Figure 5:
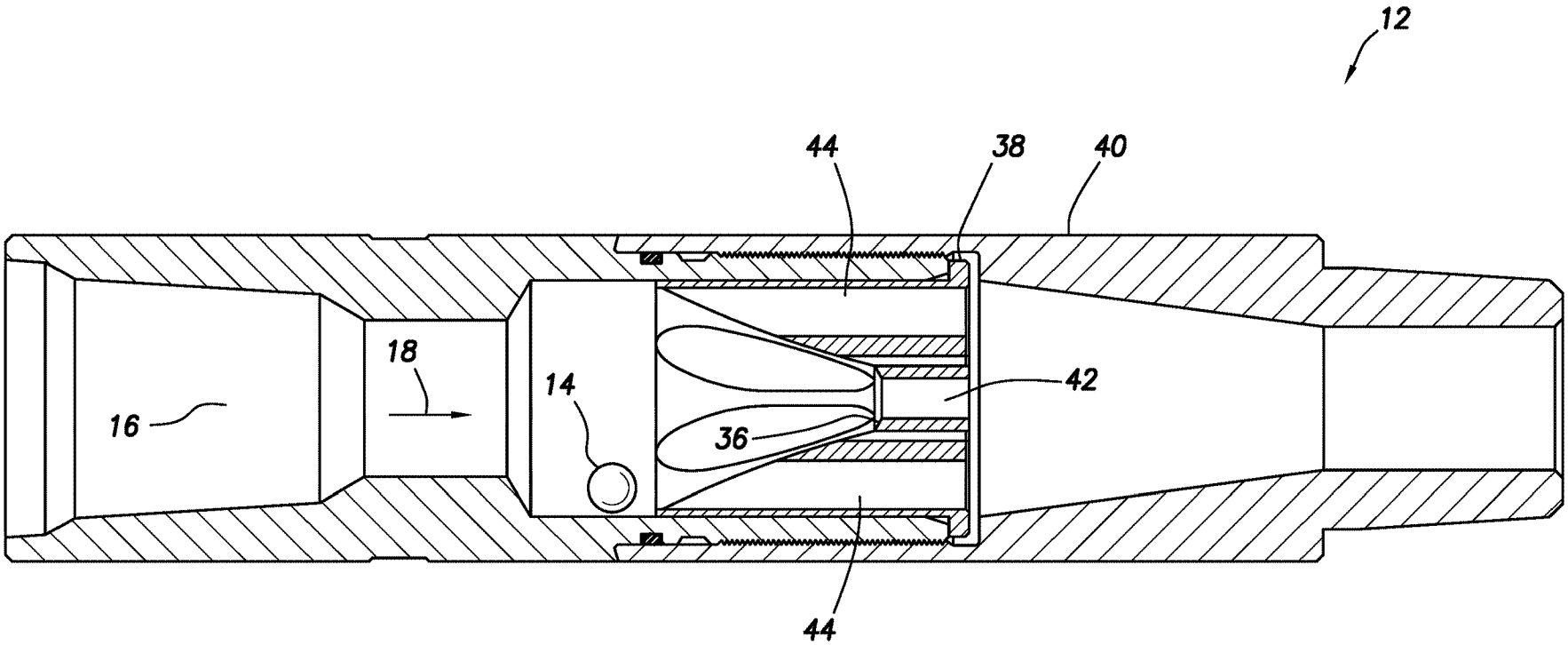
FIG. 5 is a representative cross-sectional view of the plug release tool, taken along line 5-5 of FIG. 4.

In FIGS. 3-5, an example of the downhole plug release tool 12 is representatively illustrated. In this example, the plug 14 is released from the plug release tool 12 in response to a combination of a change in orientation of the plug release tool and a change in the fluid flow 18 through the plug release tool.

As depicted in FIG. 3, the plug release tool 12 is in an inclined or generally horizontal orientation. The plug 14 is engaged with a seat 36 formed in an insert 38 secured in an outer housing 40. Multiple flow passages 42, 44 extend longitudinally through the insert 38 and form portions of the flow passage 16, which extends longitudinally through the outer housing 40.

The flow passage 42 is centrally located in the insert 38. The fluid flow 18 causes a pressure differential to be created across the plug 14 when it is engaged with the seat 36. In this manner, the plug 14 is maintained in engagement with the seat 36, even though the plug release tool 12 is in an inclined or horizontal orientation.

When the plug release tool 12 is initially deployed into the wellbore 60 as part of the BHA 68 in the FIG. 1 system 10, the plug release tool is in a generally vertical orientation, and the plug 14 is engaged with the seat 36, thereby closing off the flow passage 42. Thereafter, the fluid flow 18 through the drill string 62 will maintain the plug 14 engaged with the seat 36 (due to a pressure differential created across the plug by the fluid flow), even after the orientation of the tool 12 changes to inclined or horizontal.

When it is desired to release the plug 14, for example, to operate the vibratory tool 22, the fluid flow 18 is ceased, so that the pressure differential across the plug is relieved. If, at this point, the plug release tool 12 is in a horizontal or sufficiently inclined orientation, the plug 14 will fall away from the seat 36 by action of gravity. The plug release tool 12 may be positioned in a horizontal or sufficiently inclined orientation before or after the fluid flow 18 is ceased.

In FIG. 4, a cross-sectional view of the plug release tool 12 is representatively illustrated. In this view, the plug 14 is not depicted, and it can be seen that there are six of the flow passages 44 circumferentially distributed about the central flow passage 42. One of the flow passages 44 is in a lowermost position, directly below the central flow passage 42. However, it is not necessary for the lowermost flow passage 44 to be positioned directly below the central flow passage 42.

The number of flow passages 44 can be varied as desired. Preferably, there are enough of the flow passages 44 to ensure that at least one of them will be appropriately positioned, when the plug release tool 12 is in a sufficiently inclined or horizontal orientation, so that the plug 14 can be conveyed through the lowermost flow passage by the fluid flow 18.

In FIG. 5, the plug release tool 12 is representatively illustrated after the plug 14 has fallen away from the seat 36. The plug 14 can now be conveyed by the fluid flow 18 through the lowermost flow passage 44.

Note that, in this example, the plug 14 is too large in diameter to pass through the flow passage 42, but the plug is not too large to pass through the flow passages 44. In the event that the plug 14 should fail to fall away from the seat 36 after the fluid flow 18 is ceased and the plug release tool 12 is in a sufficiently inclined or horizontal orientation, another plug could be deployed into the flow passage 16 (such as, deployed from surface), and this other plug could be conveyed through the lowermost (or other) flow passage 44 by the fluid flow 18 and into the vibratory tool 22 (or other well tool) to operate the well tool.

Figure 6:
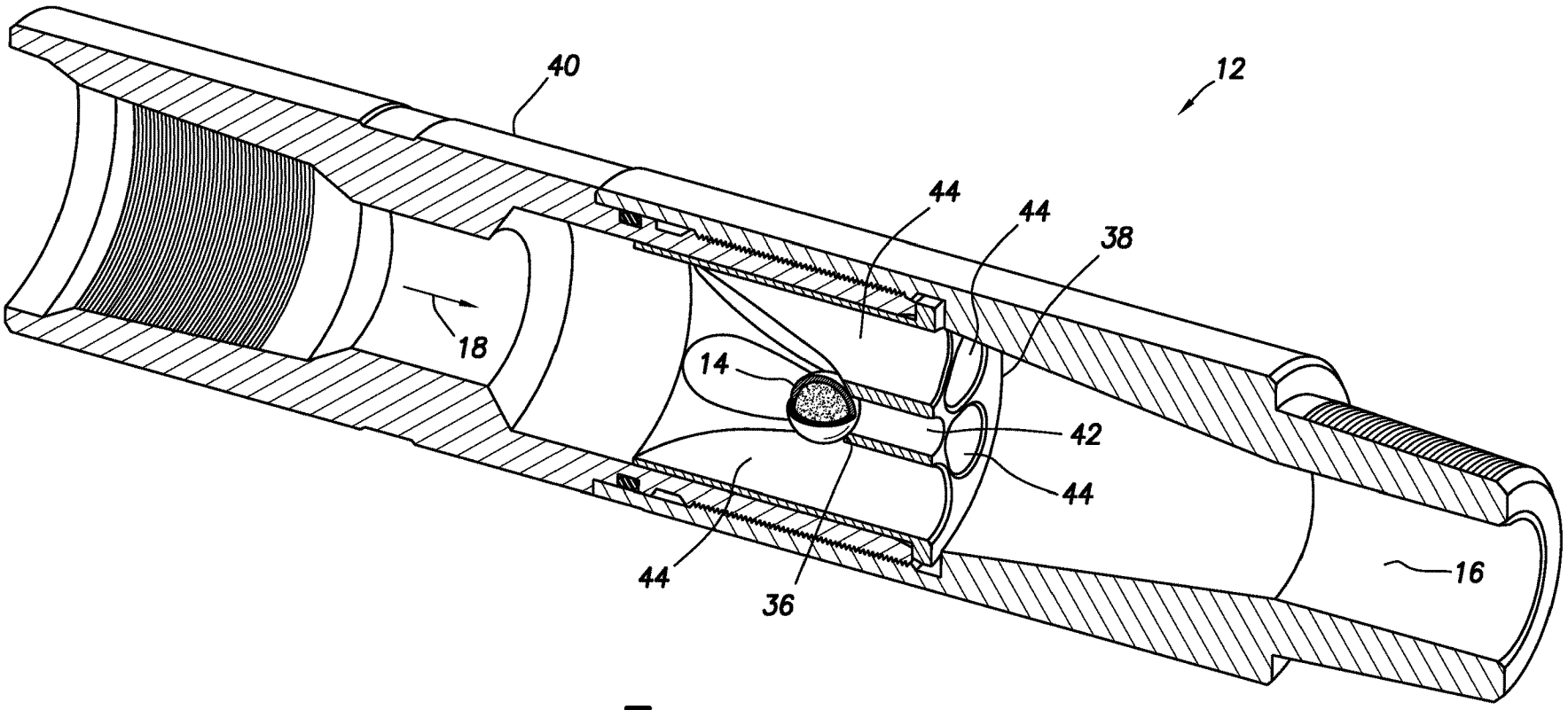
FIG. 6 is a representative cross-sectional and perspective view of the plug release tool with an example of a plug.
Figure 7:
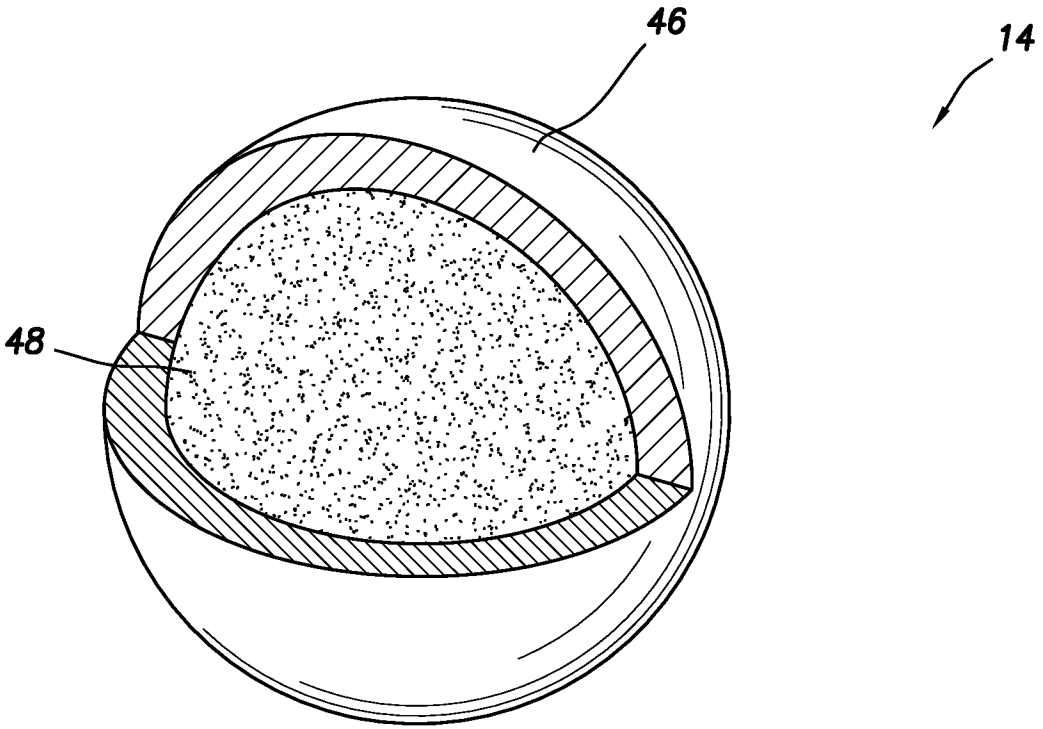
FIG. 7 is a representative cut-away view of the plug.

In FIGS. 6 & 7 another example of the plug release tool 12 is representatively illustrated. In this example, the plug 14 has at least one outer layer that initially prevents it from passing through the flow passages 44. In this manner, the plug 14 cannot inadvertently fall away from the seat 36 and pass through one of the flow passages 44 before it is intended to operate the vibratory tool 22 (or other well tool).

As depicted in FIG. 6 it may be seen that, with the outer layer on the plug 14, the plug is too large to pass through any of the flow passages 44. However, if the outer layer is degraded or dispersed downhole, so that an outer diameter of the plug 14 is decreased in this example, the plug will be able to pass through one of the flow passages 44.

As depicted in FIG. 7, the outer layer 46 covers an inner core 48 of the plug 14. The inner core 48 may be made of a suitably strong and tough material (such as, steel, tungsten carbide, etc.). However, the scope of this disclosure is not limited to use of any particular material for the inner core 48.

The outer layer 46 may be made of any material that will degrade or disperse downhole as desired. For example, the outer layer material may degrade in response to exposure to well fluid (either naturally occurring or later introduced), or in response to passage of a predetermined period of time. The outer layer material may dissolve, corrode, oxidize or hydrate in well fluid. The outer layer material may melt when exposed to downhole temperature. The outer layer material may comprise a eutectic material, magnesium, a dissolvable plastic, ploy-glycolic acid, poly-lactic acid, anhydrous boron, paraffin or wax, etc. The scope of this disclosure is not limited to any particular material of the outer layer 46.

The plug release tool 12 of FIGS. 6 & 7 operates in a similar manner to the plug release tool of FIGS. 3-5, except that the plug 14 cannot pass through the flow passages 44 until the outer layer 46 is degraded or dispersed. Note that, in this example, the plug 14 is initially too large in diameter to pass through the flow passages 42, 44, but when the outer layer 46 is degraded or dispersed the plug is not too large to pass through the flow passages 44. In the event that the plug 14 should fail to fall away from the seat 36 after the fluid flow 18 is ceased and the plug release tool 12 is in a sufficiently inclined or horizontal orientation, another plug could be deployed into the flow passage 16 (such as, deployed from surface), and this other plug could be conveyed through the lowermost (or other) flow passage 44 by the fluid flow 18 and into the vibratory tool 22 (or other well tool) to operate the well tool.

Figure 8:
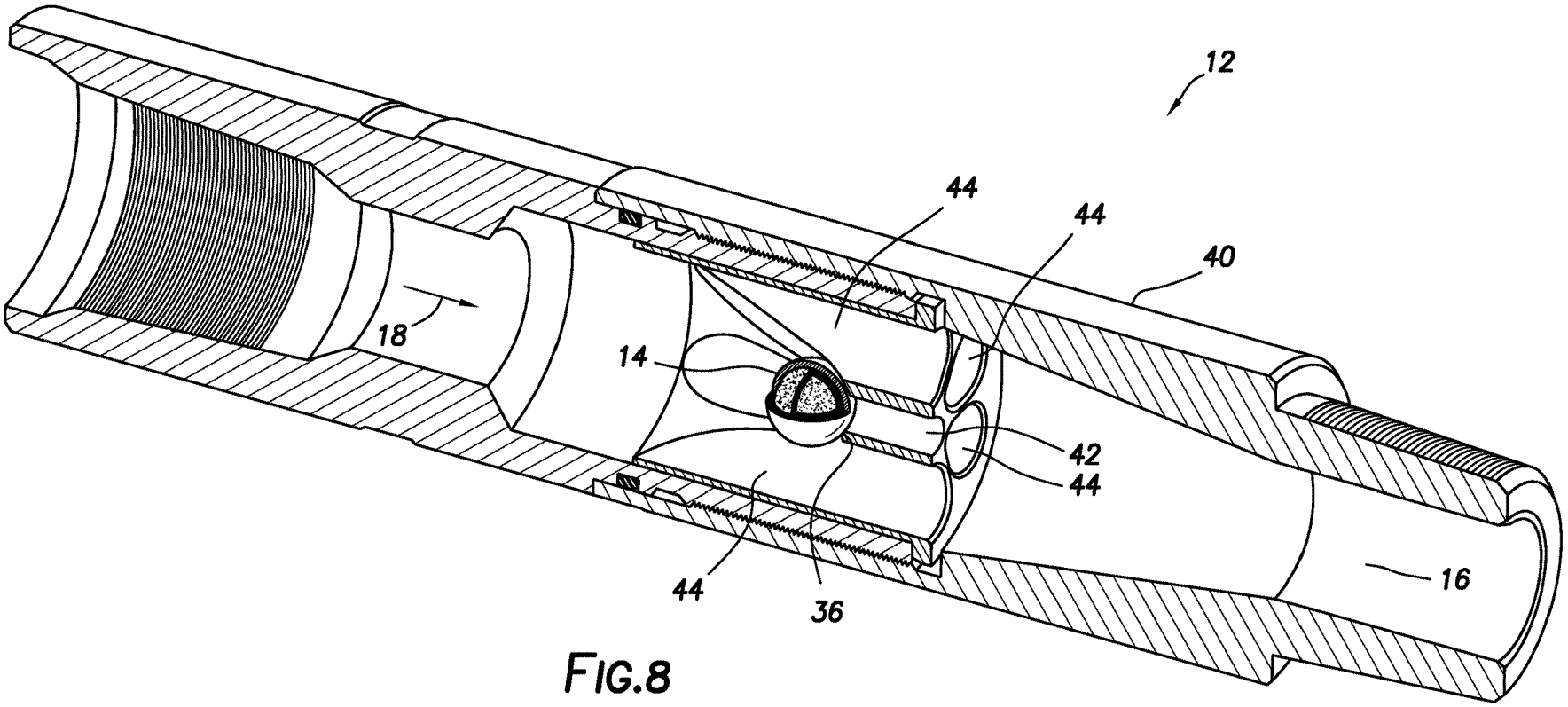
FIG. 8 is a representative cross-sectional and perspective view of the plug release tool with another example of the plug.
Figure 9:
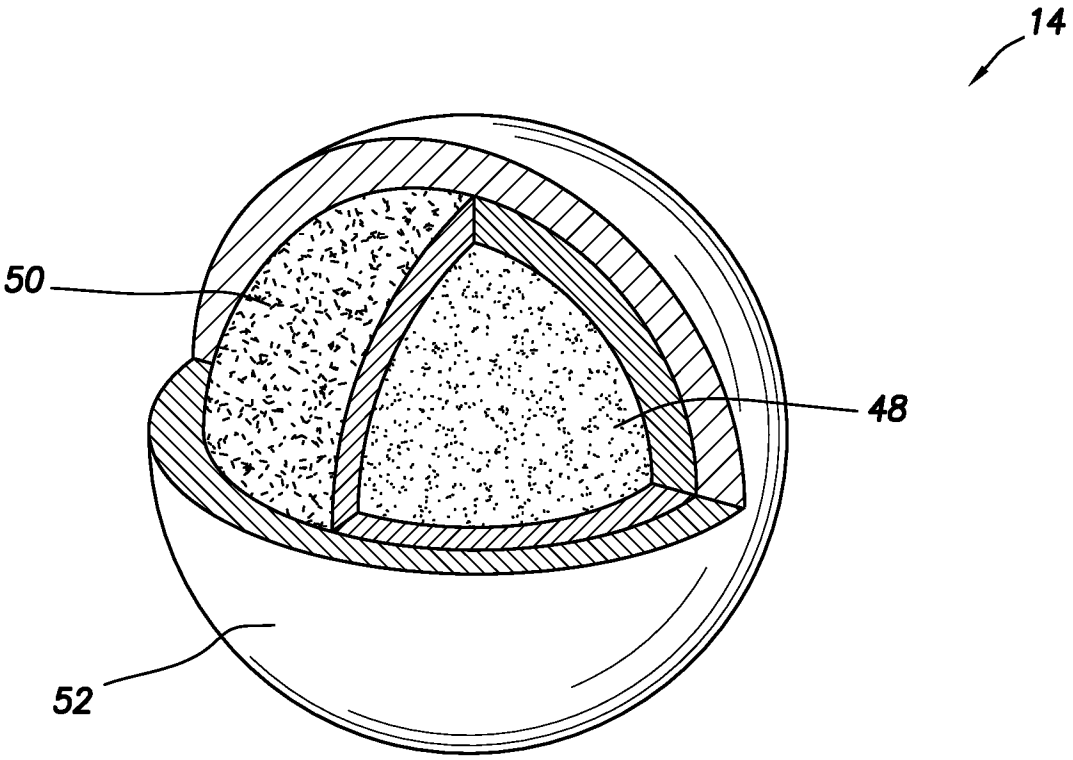
FIG. 9 is a representative cut-away view of the FIG. 8 plug.
Figure 10:
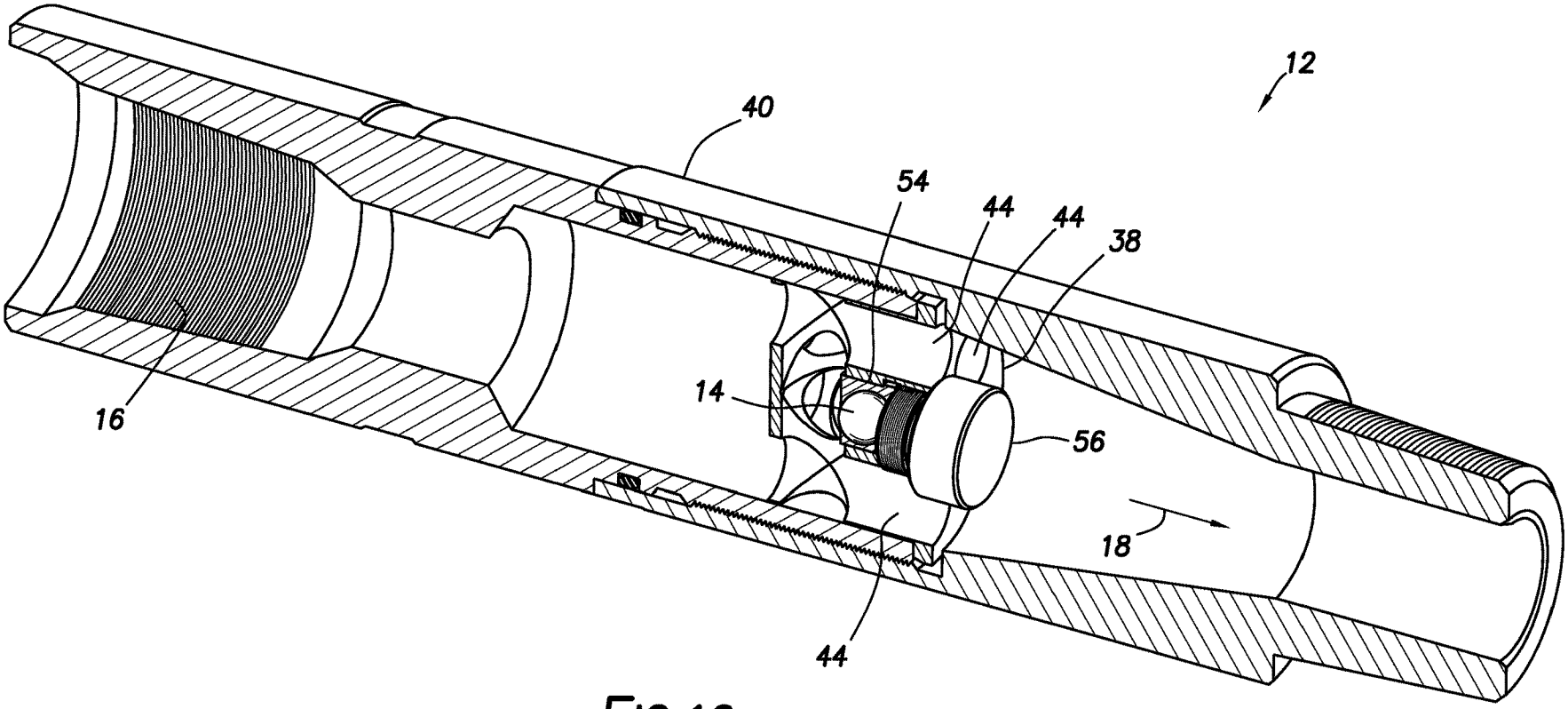
FIG. 10 is a representative cross-sectional and perspective view of another example of the plug release tool with another example of the plug.
Figure 11:
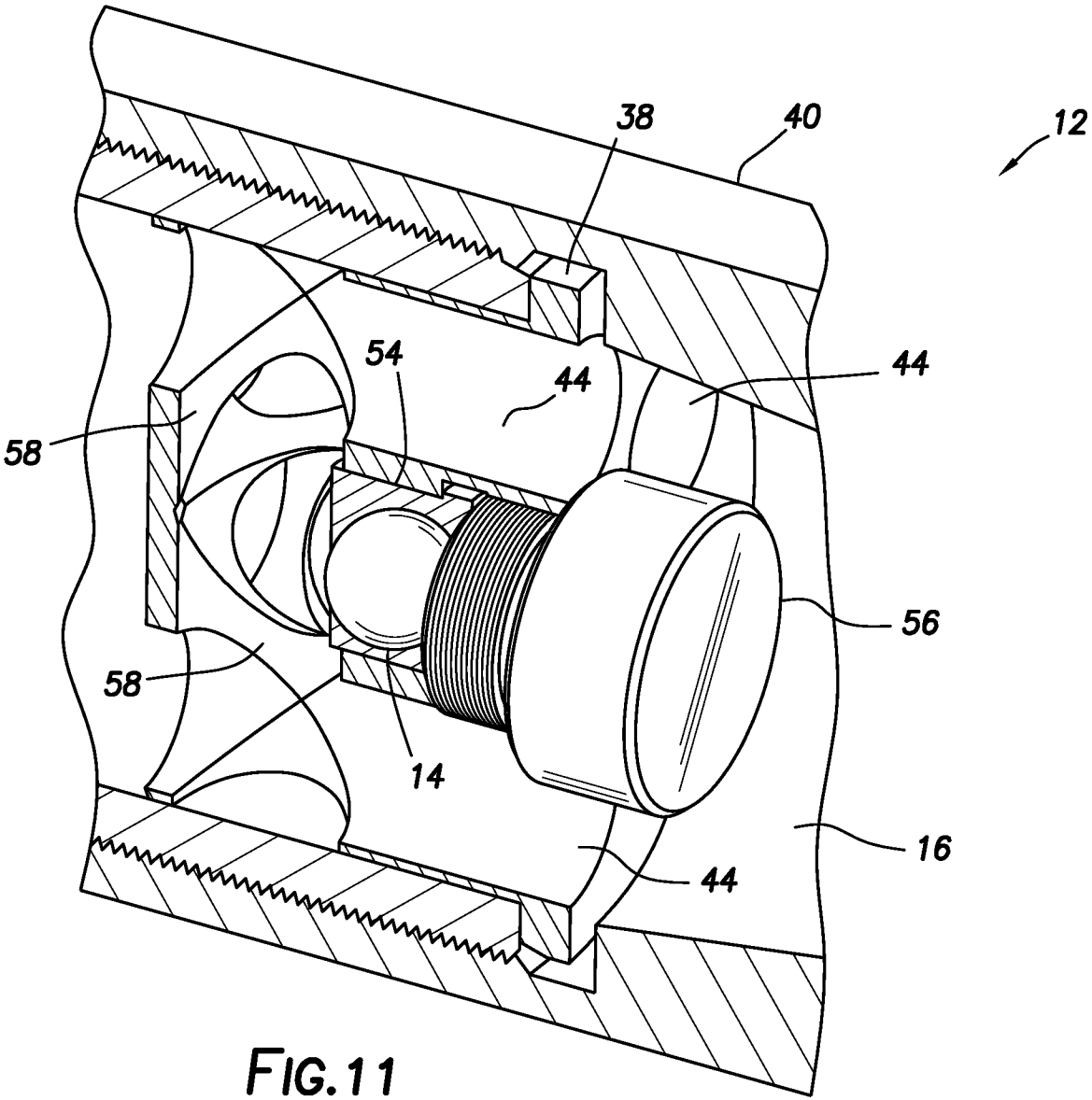
FIG. 11 is a representative cross-sectional and perspective view of a portion of the FIG. 10 plug release tool.
Figure 12:
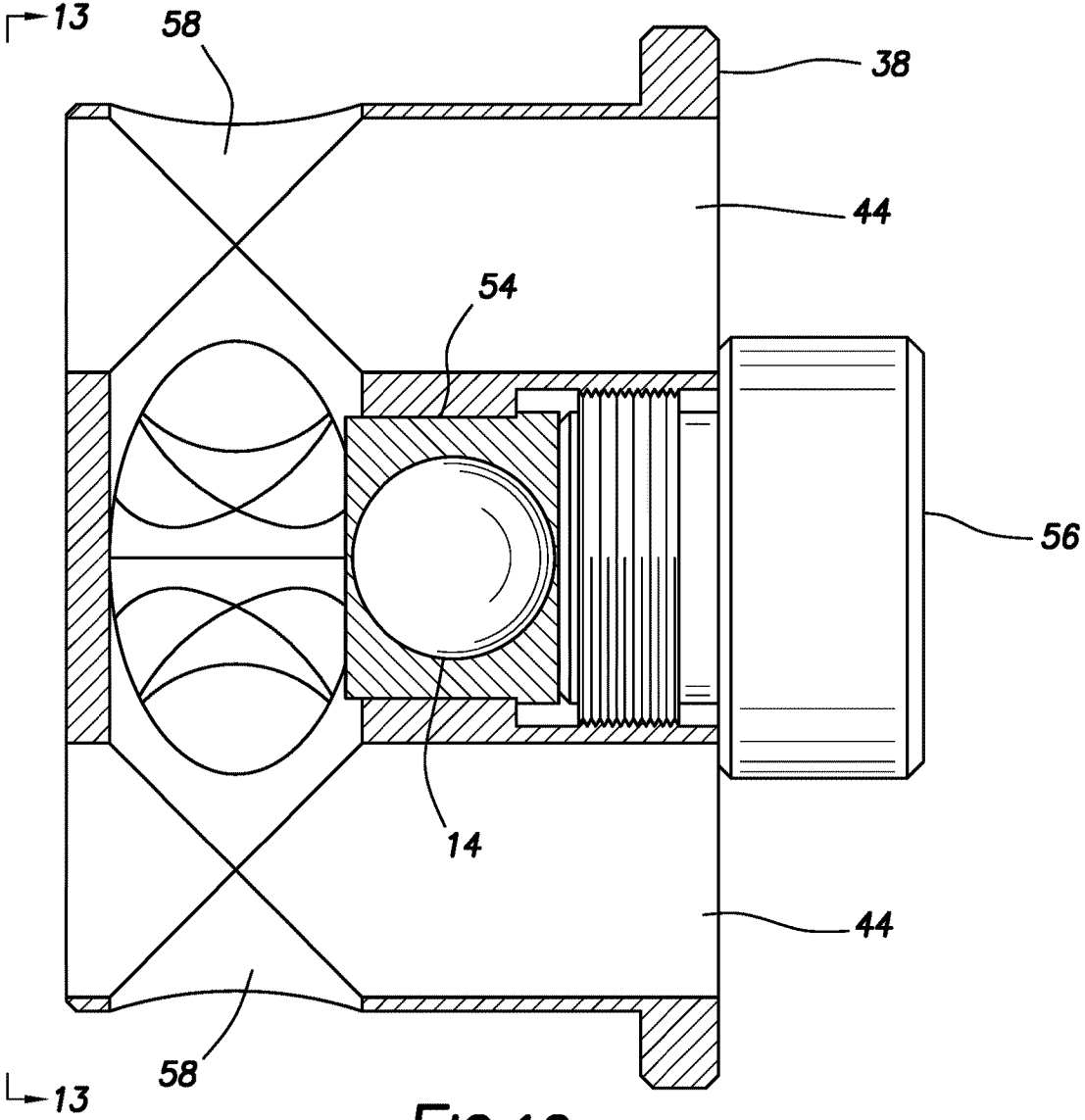
FIG. 12 is a representative cross-sectional view of an example of an insert section of the FIG. 10 plug release tool.
Figure 13:
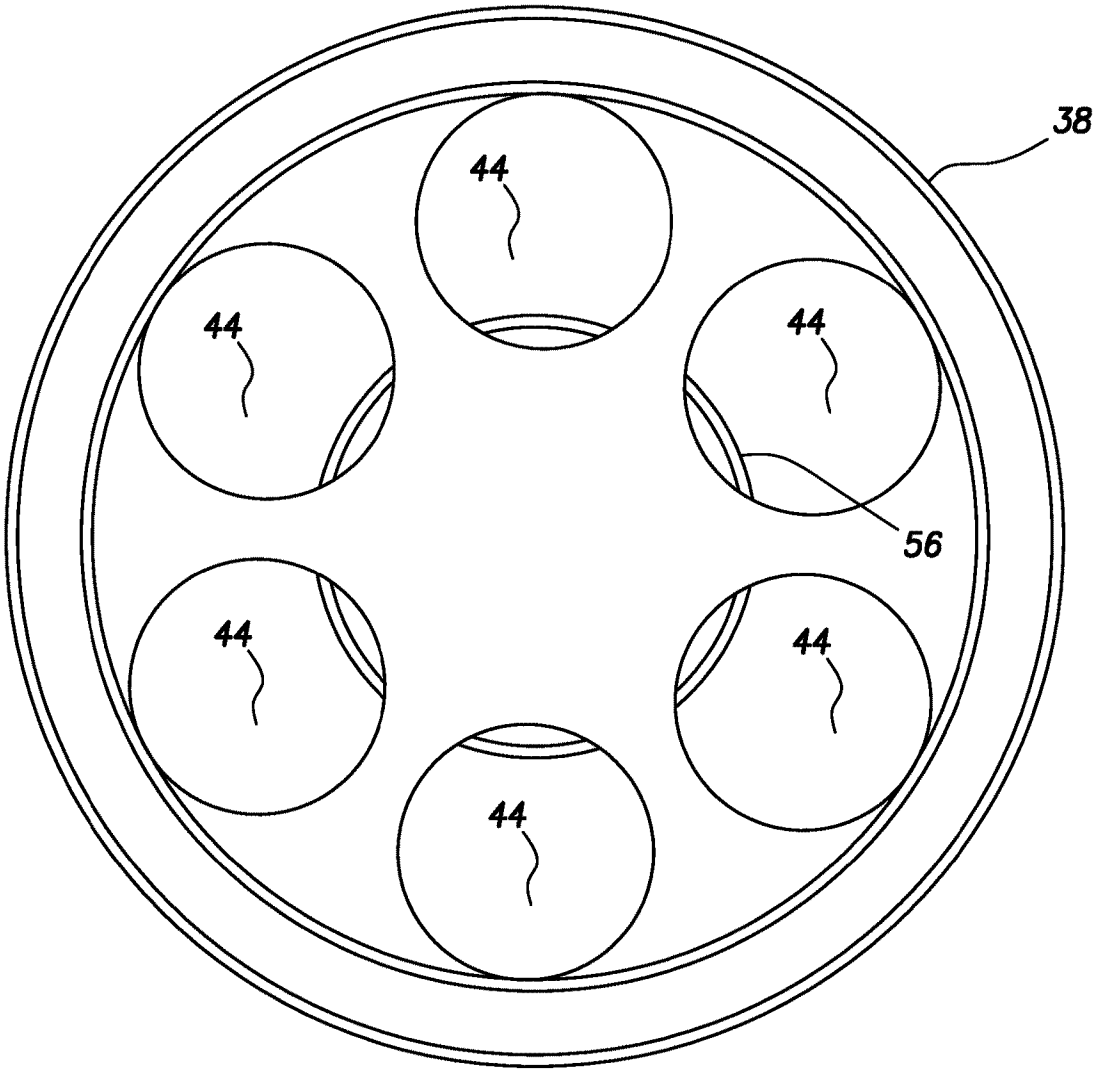
FIG. 13 is a representative end view of the insert section.

In FIGS. 8 & 9 another example of the plug release tool 12 is representatively illustrated. In this example, the plug 14 has multiple outer layers that initially prevent it from passing through the flow passages 44. In this manner, the plug 14 cannot inadvertently fall away from the seat 36 and pass through one of the flow passages 44 before it is intended to operate the vibratory tool 22 (or other well tool).

As depicted in FIG. 8 it may be seen that, with the multiple outer layers on the plug 14, the plug is too large to pass through any of the flow passages 42, 44. However, if the outer layers are degraded or dispersed downhole, so that an outer diameter of the plug 14 is decreased in this example, the plug will be able to pass through one of the flow passages 44.

As depicted in FIG. 9, a layer 50 covers an inner core 48 of the plug 14. The layer 50 may be made of any material that will degrade or disperse downhole as desired. For example, any of the materials described above for the outer layer 46 may be used for the material of the layer 50. The scope of this disclosure is not limited to any particular material of the layer 50.

An outer layer 52 covers the layer 50 of the plug 14. The outer layer 52 may be made of any material that will degrade or disperse downhole as desired. For example, any of the materials described above for the layers 46, 50 may be used for the material of the layer 52. The scope of this disclosure is not limited to any particular material of the layer 52.

In one example, the outer layer 52 could be made of a material that degrades or disperses in response to exposure to elevated well temperature (such as, a eutectic, paraffin or wax material). In this manner, the outer layer 52 would not degrade at or near the surface, but would melt or otherwise degrade and, thus, permit exposure of the layer 50 to well fluids, when the plug release tool 12 is sufficiently deep in the well and the fluid flow 18 is established to prevent inadvertent dislodgment of the plug 14 from the seat 36.

In this example, the layer 50 could be made of a material that dissolves, corrodes, oxidizes, hydrates or otherwise degrades or disperses in response to contact with well fluid. The layer 50 is prevented from contacting the well fluid until the outer layer 52 is degraded or dispersed. After the layer 50 is degraded or dispersed, the outer diameter of the plug 14 is small enough to allow the plug to pass through one of the flow passages 44 with the fluid flow 18.

The plug release tool 12 of FIGS. 8 & 9 operates in a similar manner to the plug release tool of FIGS. 3-7, except that the plug 14 cannot pass through the flow passages 44 until both of the layers 50, 52 are degraded or dispersed. Note that, in this example, the plug 14 is initially too large in diameter to pass through the flow passages 42, 44, but when the layers 50, 52 are degraded or dispersed the plug is not too large to pass through the flow passages 44.

In the event that the plug 14 should fail to fall away from the seat 36 after the fluid flow 18 is ceased and the plug release tool 12 is in a sufficiently inclined or horizontal orientation, another plug could be deployed into the flow passage 16 (such as, deployed from surface), and this other plug could be conveyed through the lowermost (or other) flow passage 44 by the fluid flow 18 and into the vibratory tool 22 (or other well tool) to operate the well tool.

In FIGS. 10-13, another example of the downhole plug release tool 12 is representatively illustrated. In this example, the plug 14 is not retained by the fluid flow 18 against the seat 36 until it is desired to release the plug. Instead, the plug 14 is retained by a retainer structure 54 that degrades or disperses downhole in order to release the plug 14.

The plug 14 and the retainer structure 54 are secured in the insert 38 by means of a threaded member 56. In other examples, the plug 14 and retainer structure 54 could be secured in the insert 38 without use of the threaded member 56, the retainer structure and the threaded member could be integrated as a single element, etc. The scope of this disclosure is not limited to any particular details of any of the plug release tool 12 examples as described herein or depicted in the drawings.

The retainer structure 54 is made of a material that degrades or disperses in the well environment as desired. For example, any of the materials described above for use in the layers 46, 50, 52 may be used in the retainer structure 54.

Thus, the plug 14 is initially retained in the insert 38 by the retainer structure 54 until the material of the retainer structure degrades or disperses in the well. This allows the plug 14 to fall by action of gravity (when the plug release tool 12 is in a sufficiently inclined or horizontal orientation) to a position in which the fluid flow 18 can convey the plug through one of the flow passages 44, and then through the remainder of the flow passage 16 to the vibratory tool 22 (or other well tool).

As in the FIGS. 3-9 examples, the FIGS. 10-13 example of the plug release tool 12 needs to be in a sufficiently inclined or horizontal orientation, in order for the plug 14 to fall and be released for conveyance with the fluid flow 18 to the vibratory tool 22 (or other well tool). However, in the FIGS. 10-13 example, the fluid flow 18 does not need to be ceased in order to allow the plug 14 to fall.

As in the FIGS. 6-9 examples, the FIGS. 10-13 example of the plug release tool 12 requires a material to be degraded or dispersed, in order for the plug 14 to be released for conveyance with the fluid flow 18 to the vibratory tool 22 (or other well tool). However, in the FIGS. 10-13 example, a material needs to be degraded or dispersed in order for the plug 14 to fall in the insert 38, but no material of the plug 14 itself is degraded or dispersed. Instead, a material retaining the plug 14 is degraded or dispersed. The plug 14 itself is small enough to pass through the flow passages 44 any time it is released from the retainer structure 54.

Note that radially extending passages 58 are formed in the insert 38 to enable the plug 14 to fall when the retainer structure 54 is degraded or dispersed. In the event that the plug 14 should fail to fall from the insert 38 when the retainer structure 54 is degraded and the plug release tool 12 is in a sufficiently inclined or horizontal orientation, another plug could be deployed into the flow passage 16 (such as, deployed from surface), and this other plug could be conveyed through the lowermost (or other) flow passage 44 by the fluid flow 18 and into the vibratory tool 22 (or other well tool) to operate the well tool.

Figure 14:
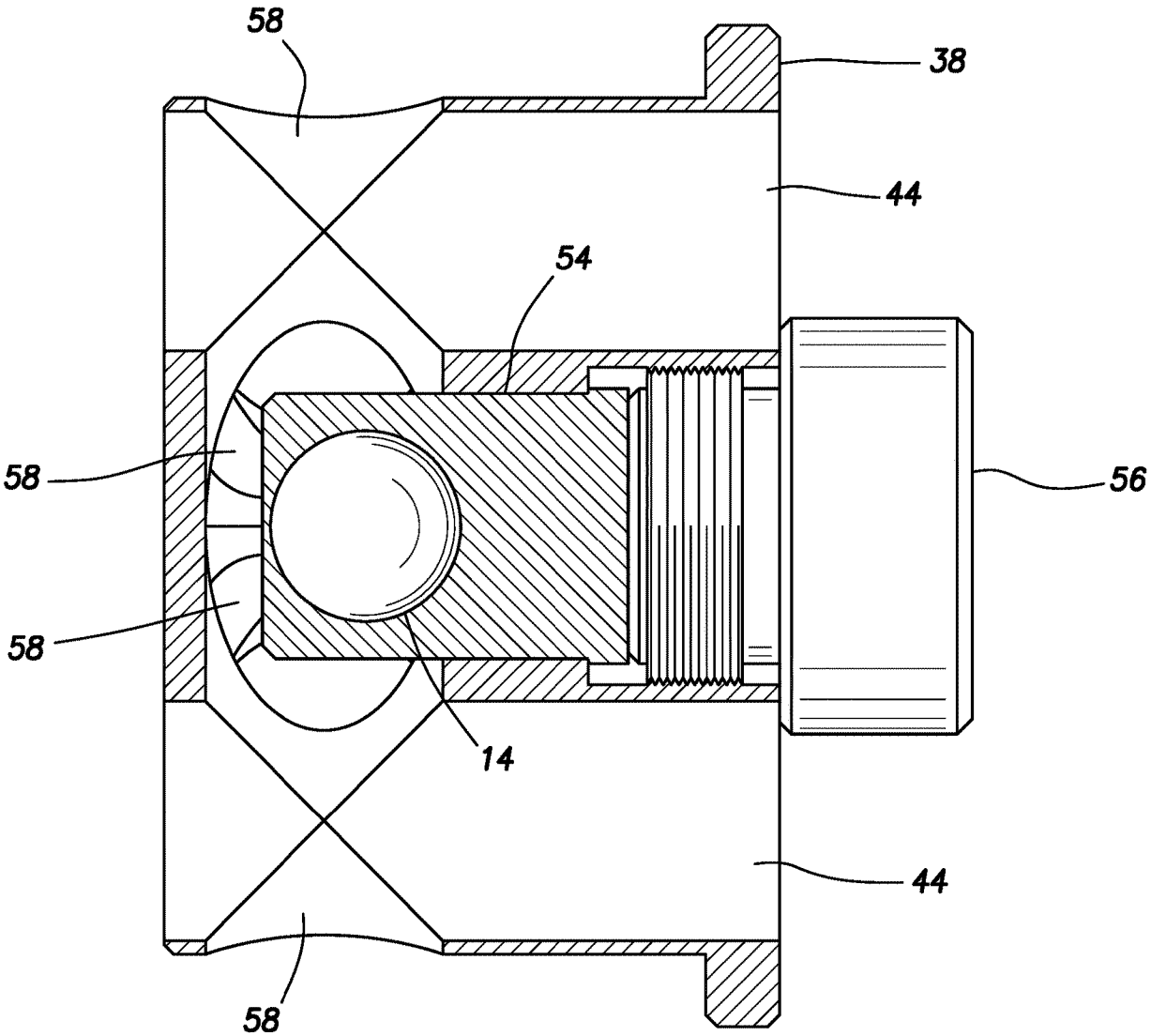
FIG. 14 is a representative cross-sectional view of the insert section with another example of the plug.

In FIG. 14, another example of the plug release tool 12 is representatively illustrated, although only the plug 14, insert 38, retainer structure 54 and threaded member 56 are depicted. The remainder of the FIG. 14 plug release tool 12 is the same as or similar to the FIGS. 10-13 example.

As depicted in FIG. 14, the retainer structure 54 is elongated as compared to the FIGS. 10-13 example. The FIG. 14 elongated retainer structure 54 positions the plug 14 so that it is more closely aligned with the radial passages 58 in the insert 38. In this manner, the plug 14 will more readily fall through one of the radial passages 58 when the retainer structure 54 is degraded or dispersed. As a result, the plug 14 can fall in the insert 38, so that it can be conveyed with the fluid flow 18 to the vibratory tool 22 (or other well tool) at less inclined (more vertical) orientations.

It may now be fully appreciated that the above disclosure provides significant advancements to the art of deploying plugs in a well. In examples described above, a plug 4 can be deployed from the plug release tool 12 when desired to activate or deactivate a well tool, such as, the vibratory tool 22.

A downhole plug release tool 12, system 10 and method are provided to the art. In one example, a plug 14 is released from the plug release tool 12 downhole, and the plug is then engaged with a well tool to thereby operate the well tool.

The operation of the well tool may comprise activating or deactivating a vibratory device 22. The operation of the well tool may comprise opening or closing a bypass passage 26 of the well tool. The operation of the well tool may comprise activating or deactivating a drill motor 66, reamer, stabilizer or other well tool.

The plug 14 may be released in response to passage of a predetermined time period, exposure to well fluid, degrading (e.g., dissolution, corrosion, melting, oxidation, hydration, etc.) of a layer 46, 50, 52 of the plug or a structure 54 retaining the plug, a change in orientation of the plug release tool 12, and/or a variation in fluid flow 18 through the plug release tool.

The plug 14 may comprise one or more outer layers 46, 50, 52. The plug 14 may be released when the one or more outer layers 46, 50, 52 is degraded, so that the plug is smaller than a passage 44 for fluid flow 18 through the plug release tool 12.

The plug 14 may comprise a layer 52 that degrades when exposed to downhole temperature, and another layer 50 that degrades when exposed to well fluid. The layer 50 that degrades when exposed to well fluid may be disposed inside the layer 52 that degrades when exposed to downhole temperature.

The above disclosure also provides a method of deploying a plug 14 in a subterranean well. In one example, the method can comprise: positioning a tool string 68 in the well, the tool string 68 including a plug release tool 12 and a well tool (e.g., the vibratory tool 22, a stabilizer, etc.); then releasing the plug 14 from the plug release tool 12; and then operating the well tool in response to releasing the plug 14.

The positioning step can include maintaining a fluid flow 18 through the plug release tool 12, thereby maintaining the plug 14 engaged with a seat 36 of the plug release tool 12. The seat 36 may be encircled by multiple flow passages 44 in the plug release tool 12.

The releasing step can include ceasing the fluid flow 18, thereby permitting the plug 14 to disengage from the seat 36. The method can include resuming the fluid flow 18 after the step of ceasing the fluid flow 18, thereby displacing the plug 14 through one of the flow passages 44 to the well tool.

The step of maintaining the fluid flow 18 may be performed at least partially while the tool string 68 is in a vertical section of a wellbore 60. The step of ceasing the fluid flow 18 may be performed while the tool string 68 is in an inclined section of the wellbore 60.

The releasing step can include degrading a layer 46, 50, 52 of the plug 14 in the plug release tool 12. The degrading step can include reducing a diameter of the plug 14, thereby permitting the plug 14 to displace through a flow passage 44 of the plug release tool 12.

The releasing step can include degrading first and second layers 50, 52 of the plug 14. The first layer 50 may degrade in response to contact with a well fluid and the second layer 52 may degrade in response to exposure to elevated temperature in the well.

The positioning step can include a retainer structure 54 of the plug release tool 12 preventing displacement of the plug 14 through a flow passage 44 of the plug release tool 12. The releasing step can include degrading the retainer structure 54.

The operating step can include activating or deactivating the well tool. The well tool may comprise a vibratory tool 22, and the operating step may include the vibratory tool 22 producing vibrations, or preventing the vibratory tool 22 from producing vibrations.

Also described above is a plug release tool 12 for use in a subterranean well. In one example, the plug release tool 12 can comprise: an outer housing 40; and an insert 38 secured in the outer housing 40. The insert 38 can comprise multiple longitudinally extending flow passages 42, 44 formed through the insert 38.

The plug release tool 12 may include a plug seat 36 formed in the insert 38. The flow passages 42, 44 may comprise a first flow passage 42 and multiple second flow passages 44. The plug seat 36 may encircle the first flow passage 42, and the second flow passages 44 may be circumferentially distributed about the first flow passage 42.

Each of the second flow passages 44 may have a diameter greater than a diameter of the first flow passage 42. The plug release tool 12 may include a plug 14. The first flow passage 42 may have a diameter less than a diameter of the plug 14, and each of the second flow passages 44 may have a diameter greater than the plug 14 diameter.

The plug release tool 12 may include a retainer structure 54 and a plug 14. The retainer structure 54 may releasably secure the plug 14 in the insert 38.

The retainer structure 54 may be degradable downhole. The flow passages 44 may be circumferentially distributed about the retainer structure 54.

The plug release tool 12 may include a plug 14. The plug 14 may comprise an inner core 48 and at least one layer 46, 50, 52 surrounding the inner core 48.

The flow passages 42, 44 may comprise a first flow passage 42 and multiple second flow passages 44. The first flow passage 42 may have a diameter less than a diameter of the inner core 48, and each of the second flow passages 44 may have a diameter greater than a diameter of the inner core 48.

The "at least one" layer 46, 50, 52 may be degradable downhole. The "at least one" layer 46, 50, 52 may comprise first and second layers 50, 52. The first layer 50 may be degradable in response to contact with a well fluid, and the second layer 52 may be degradable in response to exposure to elevated downhole temperature.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A plug release tool for use in a subterranean well, the plug release tool comprising:

an outer housing; and an insert secured in the outer housing, the insert comprising a central longitudinal flow passage and multiple circumferentially distributed longitudinal flow passages radially disposed about the central longitudinal flow passage, in which the plug release tool is configured to releasably retain a plug within the plug release tool, in which the plug closes off the central longitudinal flow passage while the plug is releasably retained within the plug release tool, and in which the plug exits the plug release tool via one of the multiple circumferentially distributed longitudinal flow passages when the plug is released from the plug release tool.

2. The plug release tool of claim 1, further comprising a plug seat formed in the insert.

3. The plug release tool of claim 2, in which the plug seat encircles the central longitudinal flow passage, and the multiple circumferentially distributed longitudinal flow passages are circumferentially distributed about the central longitudinal flow passage.

4. The plug release tool of claim 3, in which each of the multiple circumferentially distributed longitudinal flow passages has a diameter greater than a diameter of the central longitudinal flow passage.

5. The plug release tool of claim 3, in which the central longitudinal flow passage has a diameter less than a diameter of the plug, and each of the multiple circumferentially distributed longitudinal flow passages has a diameter greater than the plug diameter.

6. The plug release tool of claim 1, in which the plug comprises an inner core and at least one layer surrounding the inner core.

7. The plug release tool of claim 6, in which the central longitudinal flow passage has a diameter less than a diameter of the inner core, and each of the multiple circumferentially distributed longitudinal flow passages has a diameter greater than a diameter of the inner core.

8. The plug release tool of claim 6, in which the at least one layer is degradable downhole.

9. The plug release tool of claim 6, in which the at least one layer comprises first and second layers, the first layer being degradable in response to contact with a well fluid and the second layer being degradable in response to exposure to elevated downhole temperature.

10. The plug release tool of claim 1, in which the plug is releasably retained in the plug release tool by fluid flow.

* * * * *